US007736569B2

(12) United States Patent
Baur et al.

(10) Patent No.: US 7,736,569 B2
(45) Date of Patent: Jun. 15, 2010

(54) APPARATUS AND METHOD FOR DISPENSING CARBON FIBER INTO CONCRETE

(75) Inventors: Kenneth Baur, Mohnton, PA (US); Harry A. Gleich, Greenville, SC (US); Charles K. Gantt, Jr., Liberty, SC (US); W. Cecil Wilson, Westminster, SC (US)

(73) Assignee: Oldcastle Precast, Inc., Auburn, WA (US)

( * ) Notice: Subject to any disclaimer, the term of this patent is extended or adjusted under 35 U.S.C. 154(b) by 42 days.

(21) Appl. No.: 11/950,288

(22) Filed: Dec. 4, 2007

(65) Prior Publication Data

US 2008/0134625 A1 Jun. 12, 2008

Related U.S. Application Data

(60) Provisional application No. 60/868,506, filed on Dec. 4, 2006.

(51) Int. Cl.
*B29C 70/00* (2006.01)
*E04B 1/16* (2006.01)

(52) U.S. Cl. ..... 264/279.1; 264/35; 264/257; 264/258; 264/271.1; 264/275; 264/333; 156/42

(58) Field of Classification Search ..... 264/257, 264/258, 333, 271.1, 275, 279.1, 35; 156/42
See application file for complete search history.

(56) References Cited

U.S. PATENT DOCUMENTS 2,741,955 A * 4/1956 Magnani ..... 162/268
3,944,698 A * 3/1976 Dierks et al. ..... 428/219
4,450,022 A * 5/1984 Galer ..... 156/42

* cited by examiner

*Primary Examiner*—Khanh Nguyen
*Assistant Examiner*—Carson Gross
(74) *Attorney, Agent, or Firm*—Sheridan Ross P.C.

(57) ABSTRACT

The present invention relates to an apparatus and method for selectively dispensing reinforcement material into a concrete component. The apparatus is capable of providing, positioning and embedding any form of rolled reinforcement materials into both prefabricated concrete components and cast-in-place concrete components which can be operated by a minimal number of personnel in a timely and economical manner, and which can be used to mass produce concrete components.

3 Claims, 7 Drawing Sheets

APPARATUS AND METHOD FOR DISPENSING CARBON FIBER INTO CONCRETE

This application claims the benefit of U.S. Provisional Patent Application Ser. No. 60/868,506, filed Dec. 4, 2006, the entire disclosure of which is incorporated by reference herein.

FIELD OF THE INVENTION

The present invention relates generally to a device for selectively dispensing, positioning and embedding strengthening material directly into a precast or cast-in-place concrete component fabrication. More specifically, one embodiment of the present invention selectively dispenses and positions a rolled strengthening material, such as carbon fiber, directly into a concrete component.

BACKGROUND OF THE INVENTION

Structural or load-bearing components of buildings and structures, such as bearing walls or bridge supports, are constructed from a variety of materials including, but not limited to, wood, steel, and concrete. Concrete has many properties that make it ideally suitable for the construction of these structures, such as enhanced fire protection and durability, as well as favorable vibration and sound transmission characteristics. Traditionally, concrete structural or load bearing components are fabricated by cast-in-place techniques wherein the concrete is poured at the building site to form the components. Recently, however, the construction industry has seen an increasing use of prefabricated concrete building components where structural or load-bearing components are cast off-site and delivered to the construction site. Such prefabricated concrete components decrease construction times and can reduce the number of personnel at the building site, thereby resulting in an overall reduction of construction costs.

Because prefabricated concrete components are cast in a factory and transported to a building site, there is a significant need to create components that are strong enough for use in structural or load-bearing applications, but that are also lightweight and capable of resisting cracking and other damage that is associated with transportation. This need has been addressed by embedding materials into the prefabricated components during the casting process that not only make the components lighter in weight, but also serve to enhance their mechanical properties. In many precasting processes, particularly where structural or load-bearing components are involved, metallic mesh or reinforcing bars, such as rebar or high-tensile strength stainless steel, are embedded. Recently, however, other types of reinforcement materials have been substituted for metallic mesh and reinforcing bars with positive results. These materials include alkali-resistant glass, PVC, PVA, polypropylene, polyethylene, polyester, acrylic and kevlar, crysotile or crocidolite asbestos, high-modulus or high-strength carbon fibers, as well as natural fibers such as wood, sisal, coconut, bamboo, jute, akwara and elephant grass. As can be appreciated, these materials are typically lighter in weight than metallic mesh or reinforcing bars, display a greater degree of flexibility, and are also corrosion-resistant. Because embedding reinforcing materials such as these into prefabricated concrete components has successfully reduced their weight and enhanced their mechanical properties, the construction industry has also embedded these materials in cast-in-place applications where lighter weight concrete components with greater tensile strength are desired.

While embedding materials such as these into prefabricated concrete components has served to enhance the mechanical properties of the components and to make them lighter in weight, substantial expense can still arise from the labor costs and efforts needed to properly provide, position, and embed the reinforcement materials into the components during casting. Increased expenses are often associated with the fact that each step of providing, positioning and embedding typically occurs separately and each requires several workers to be properly accomplished, thereby increasing the time of manufacture, as well as the cost.

SUMMARY OF THE INVENTION

Accordingly, it is one aspect of embodiments of the present invention to provide an apparatus that provides, positions and embeds reinforcing materials into prefabricated concrete components that can be operated by a minimal number of personnel and that can be used to mass produce prefabricated concrete components quickly and economically. As provided herein, "reinforcement materials" includes metallic mesh or reinforcing bars, high-tensile strength stainless steel, alkali-resistant glass, fiberglass, synthetic materials such as polypropylene, PVA, PVC, polyethylene, polyester, acrylic and kevlar, crysotile or crocidolite asbestos, high-modulus or high-strength carbon fibers, natural fibers such as wood, sisal, coconut, bamboo, jute, akwara and elephant grass, and any similar materials and/or any other materials that can be rolled onto a roller assembly. It is also contemplated that embodiments of the present invention are capable of providing, positioning and embedding reinforcement materials into cast-in-place concrete components at a building site quickly and economically that can be operated by a minimal number of personnel.

In one embodiment, the apparatus comprises at least one payoff carriage capable of housing a rolled reinforcement material and feeding the free end of the rolled reinforcement material into a pair of compliant nip rollers in order to meter or dispense the reinforcement material into the embedding area. After the material is dispensed, an embedment roller assembly embeds the material into a concrete form at a desired depth or elevation. The apparatus may also comprise a screed leveling beam that follows behind the embedment roller assembly in order to smooth the concrete after embedment of the reinforcement material. The screed leveling beam also has edge wings on it that serve to contain the concrete within the desired form, so that substantially no concrete is lost during the smoothing process. The apparatus also comprises a cut off mechanism whereby the reinforcement material can be quickly and evenly cut once the desired amount has been dispensed. One skilled in the art will appreciate that the cut off mechanism may also chop the reinforcing material. The apparatus is generally self propelled and, preferably, employs a diesel powered hydraulic system in order to accomplish its various functions. The apparatus also has a single control panel where each of its functions may be operated.

In another embodiment, the apparatus is configured to operate on a set of two rails, in a manner much like a train or rail car. In another embodiment, the apparatus is configured to operate on wheels and is freely mobile.

In another embodiment, the embedment roller assembly of the apparatus has high frequency vibrating mechanisms attached to it in order to facilitate embedment of the reinforcing material without damaging it in any way.

In another embodiment, the screed leveling beam of the apparatus oscillates to facilitate the creation of a smooth surface on the concrete after the material has been embedded.

It is yet another aspect of the present invention to provide an apparatus that is adapted to place other items within the concrete during fabrication. More specifically, embodiment of the present invention are capable of additionally incorporating brackets, pins, clips, insulation, wires, conduit, pipes, rebar, mesh, etc. into the concrete component being fabricated. This ability may be used alone or in conjunction with those aspects described above. In addition, it is contemplated that the apparatus may be capable of defining, cutting, or otherwise forming an opening, such as for a door, a window, a utility conduit, etc. in the concrete component being formed.

It is another aspect of the present invention to provide a method of selectively providing, positioning and embedding rolled reinforcement materials into prefabricated concrete components via the use of at least one embodiment of the apparatus of the present invention.

It is another aspect of the present invention to provide a method of selectively providing, positioning and embedding rolled reinforcement materials into cast-in-place concrete components via the use of at least one embodiment of the apparatus of the present invention.

It is another aspect of the present invention to provide a method of mass producing concrete components via the use of at least one embodiment of the apparatus of the present invention.

The Summary of the Invention is not intended to be, nor should it be construed as being, representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these embodiments.

Figure 1:
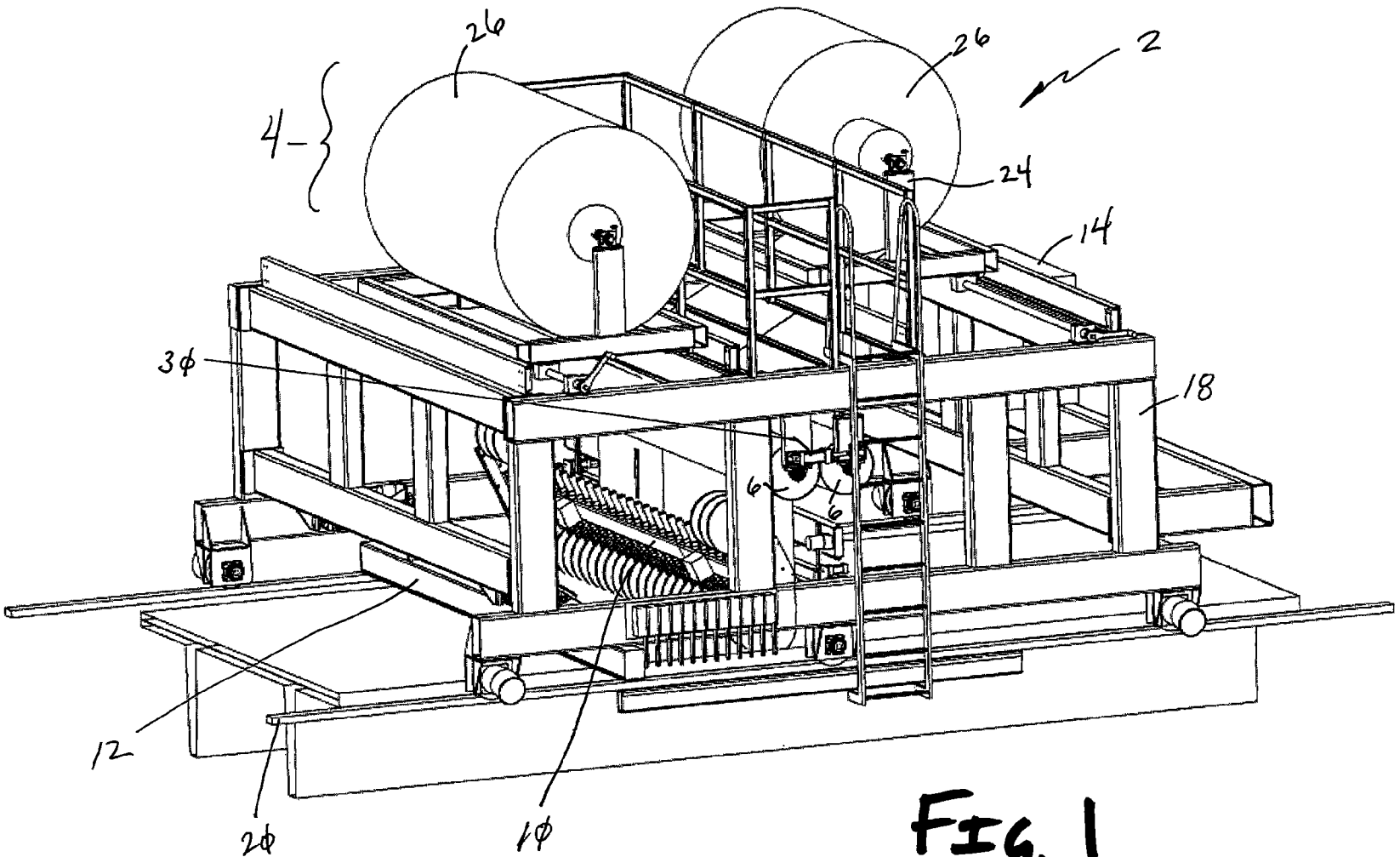
FIG. 1 is a front perspective view of one embodiment of the apparatus of the present invention.

To assist in the understanding of the present invention, the following list of components and associated numbering found in the drawings is provided herein:

| Component | # |
|---|---|
| Embedding Machine | 2 |
| Payoff Carriage | 4 |
| Nip Rollers | 6 |
| Cut Off Mechanism | 8 |
| Embedment Roller Assembly | 10 |
| Screed Leveling Beam | 12 |
| Engine | 14 |
| Control Panel | 16 |
| Frame | 18 |
| Rails | 20 |
| Wheels | 22 |
| Mandrel Axle Receiver | 24 |
| Roll | 26 |
| Mandrel Axle Collar | 28 |
| Control Cylinders | 30 |
| Cutting Blade | 32 |
| Cut Off Motor | 34 |
| Arbor | 35 |
| Cut Off Carriage | 36 |
| Beam | 38 |
| Rollers | 40 |
| Adjustment Means | 42 |
| Oscillation Motor | 44 |
| Attachment Arms | 46 |
| Edge Wings | 48 |
| Concrete Component | 50 |
| Positioning Roller | 52 |

It should be understood that the drawings are not necessarily to scale. In certain instances, details which are not necessary for an understanding of the invention or which render other details difficult to perceive may have been omitted. It should be understood, of course, that the invention is not necessarily limited to the particular embodiments illustrated herein.

DETAILED DESCRIPTION

Figure 2:
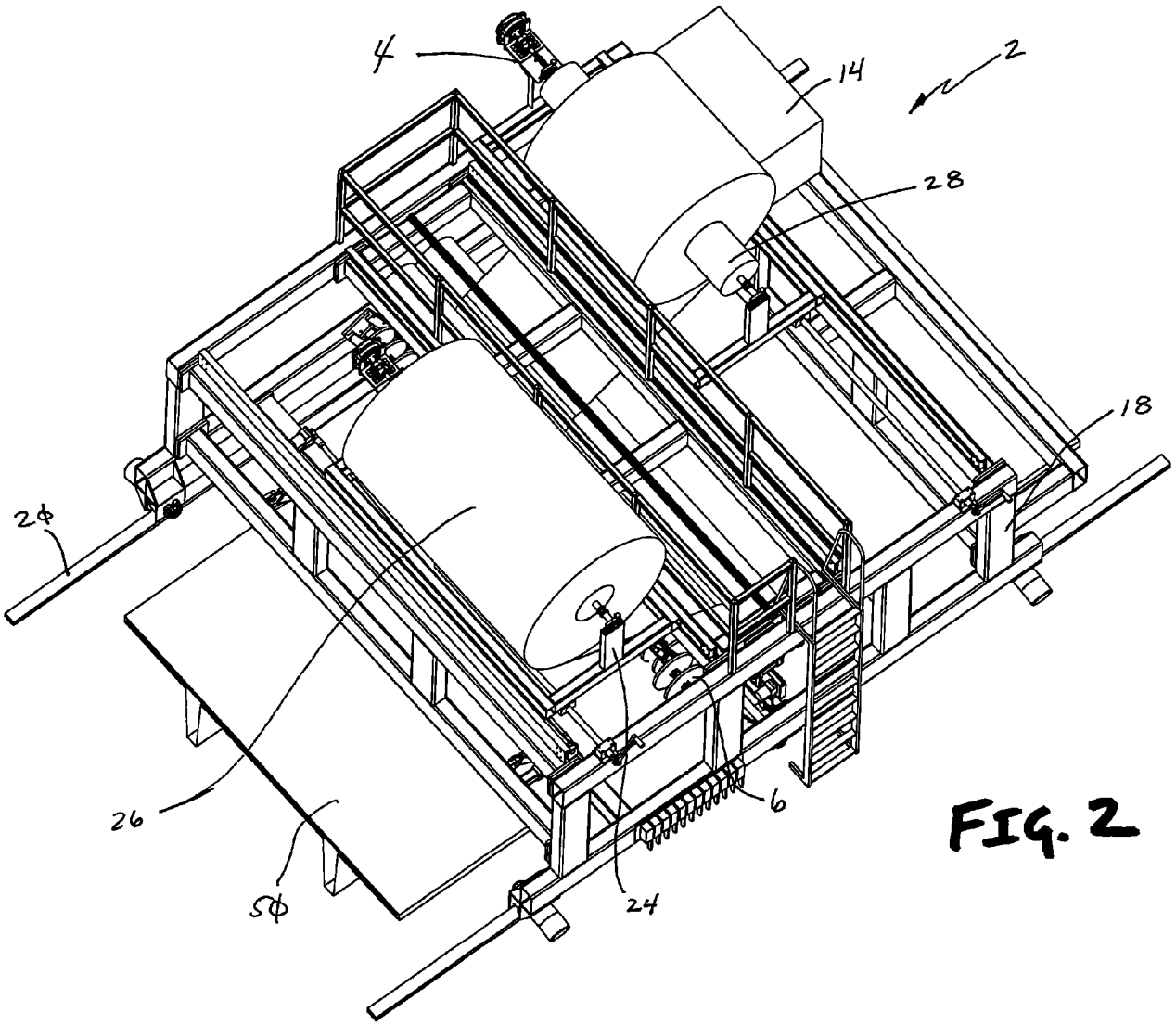
FIG. 2 is a top perspective view of the apparatus shown in FIG. 1.

Referring now to FIGS. 1 and 2, an apparatus according to certain embodiments of the invention is shown. The apparatus is an embedding machine 2 that includes at least one, and preferably at least two, payoff carriages 4 that each house a large roll 26 of reinforcement material. The free end of the reinforcement material is fed from the payoff carriage 4 to a pair of compliant nip rollers 6 that meter and/or dispense the reinforcement material from the rolls 26 to an embedding area beneath the embedding machine 2, where an embedment roller assembly 10 embeds the reinforcement material into the concrete component 50 at a specific, desired depth. The embedding machine 2 also includes a cut off mechanism 8 that serves to quickly and evenly cut the reinforcement material when a desired amount has been dispensed into the embedding area. A screed leveling beam 12 is present a short distance downstream from the embedment roller assembly 10 which generally serves to smooth the surface of the concrete component 50 after the embedment roller assembly 10 has embedded the reinforcement material therein. The embedding machine 2 is self-propelled and includes an engine 14 that allows the embedding machine 2 to move and provides power to each of the embedding machine's 2 component parts. For ease of operation, the embedding machine 2 includes a control panel 16 that controls each functional component and allows the embedding machine 2 to be operated by a single person.

The structure of the embedding machine in one embodiment comprises a frame 18 that is preferably made of a material of very high strength and durability and that is capable of bearing the weight of at least one, preferably at least two, and as many as five 1,500 pound rolls of reinforcement material in addition to the functional components of the embedding machine 2 itself. The frame 18 is preferably made of structural steel, but may also be made of any suitable material such as iron, wrought iron, cementite, and similar materials.

The embedding machine 2 is self-propelled in one embodiment and preferably utilizes hydraulics to power all of its moving components, though these components may also be powered by pneumatics, electricity, mechanics, and other energy sources. The engine 14 is preferably a liquid cooled, 60 horse power diesel engine that drives a 32 GPM, variable volume, pressure compensating hydraulic pump, which provides the necessary power for each of the moving components of the embedding machine 2, as well as its propulsion. The engine 14 and the hydraulic pump preferably operate to utilize a hydraulic reservoir of 70 gallons to maintain an hydraulic system pressure of 1,200 psi.

In the embodiment shown in FIGS. 1 and 2, the mobility of the embedding machine 2 is provided by a pair of rails 20 and specialized wheels 22 configured to travel along the rails 20. While this is the preferred embodiment, the embedding machine 2 may also be configured to propel itself via other means such as wheels, tires, tank-like tracks, or other forms of mechanical propulsion capable of moving large, heavy objects.

The embedding machine 2 preferably includes at least two payoff carriage 4 assemblies and is configured to contain up to five such assemblies, though it is possible to configure the embedding machine 2 to contain additional payoff carriages 4 beyond five, if desired. Each carriage assembly 4 is configured to house a single roll 26 of reinforcement material, weighing up to 1,500 pounds and contained on a 16-inch core that has a 48-inch outside diameter and is 95 inches in width. In the preferred embodiment, the reinforcing material contained on each roll 26 is high-modulus or high-strength carbon fiber mesh, though the reinforcing material, as previously mentioned, may be any other suitable reinforcing material capable of being rolled, such as alkali-resistant glass fiber, polypropylene, polyethylene, polyester, acrylic, kevlar, crysotile or crocidolite asbestos, sisal fiber, coconut fiber, bamboo fiber, jute or similar vegetable fiber, akwara or date palm fiber, elephant grass, or similar materials.

The payoff carriage 4 assemblies are configured along the top of the frame 18 of the embedding machine 2 in such a way so as to be slidably adjustable along the width of the frame 18, allowing for placement, and therefore embedding, of reinforcement material along virtually the entire width of the frame 18, ranging from one inch away from each side rail of the frame 18 to any location in between. By staggering the location of two or more payoff carriages 4, the embedding machine 2 is thus capable of embedding reinforcing material in an amount equal to its width, less two inches, in a single pass. As can be appreciated, this confers a substantial advantage to the embedding machine 2 over traditional means of embedding reinforcing material. As can also be appreciated, it is desirable to configure the payoff carriages 4 along the frame 18 such that the strengthening material dispensed from the rolls 26 overlaps (see, e.g., FIGS. 7-11), thereby preventing the creation of weak spots in the concrete component 50.

Each payoff carriage 4 assembly includes a mandrel axle with a collar 28 for insertion into the core of a roll 26 of reinforcing material, which collar 28 is configured to allow free rotation of the roll 26 about the axle. The collar 28 engages the inner diameter of the core of a roll 26 and may be quickly slid off of the mandrel axle to facilitate exchange of rolls 26. To help ensure that the embedding machine 2 operates quickly and efficiently, each payoff carriage 4 may have one or more extra collars 28, thereby allowing a spare collar 28 to be loaded with a roll 26 while the original is in use on the embedding machine 2. In addition, each mandrel axle engages its payoff carriage 4 by a pair of mandrel axle receivers 24, which house each end of the mandrel axle, respectively, and each axle has lift eyes at each end to allow loading and/or removing with an overhead crane. During operation of the embedding machine 2, it is necessary for the reinforcement material to remain taught to ensure proper placement and embedding. In order to help maintain the proper amount of tension on the reinforcing material, each payoff carriage 4 has an adjustable, hydraulic pay off brake which slows, stops, or reverses the direction of rotation of the collar about the mandrel axle in order to maintain tension in the strengthening material.

The nip rollers 6 of the present invention are preferably 16 inches in diameter, 12 feet, 6 inches in length and has a one-quarter inch thick compliant medium bonded to its outer surface which assists the nip rollers 6 in accepting and gripping the reinforcing material during operation of the embedding machine 2. When in use, the nip rollers 6 serve to meter and/or dispense the strengthening material downward, away from the payoff carriages 4 and toward the embedding area under the embedding machine 2, and/or to take up the reinforcement material away from the embedding area and back toward the rolls 26. This is achieved when the nip rollers 6 clamp onto the reinforcement material and begin to rotate in such a way as to dispense the material, or to take it up. The relative speed and the direction of rotation of the nip rollers 6 determines how quickly the reinforcing material is dispensed from the rolls 26 and onto the concrete component 50 for embedding, or how quickly the material is taken up and away from the concrete component 50. The clamping and rotation of the nip rollers 6 is achieved via hydraulic pressure controlled cylinders 30 which are driven by hydraulic motors. These hydraulic motors are controlled by valves located at the control panel 16, which allow the operator to control whether the nip rollers 6 clamp or release the reinforcing material and/or whether and how fast they pay out or take up the material.

Figure 3:
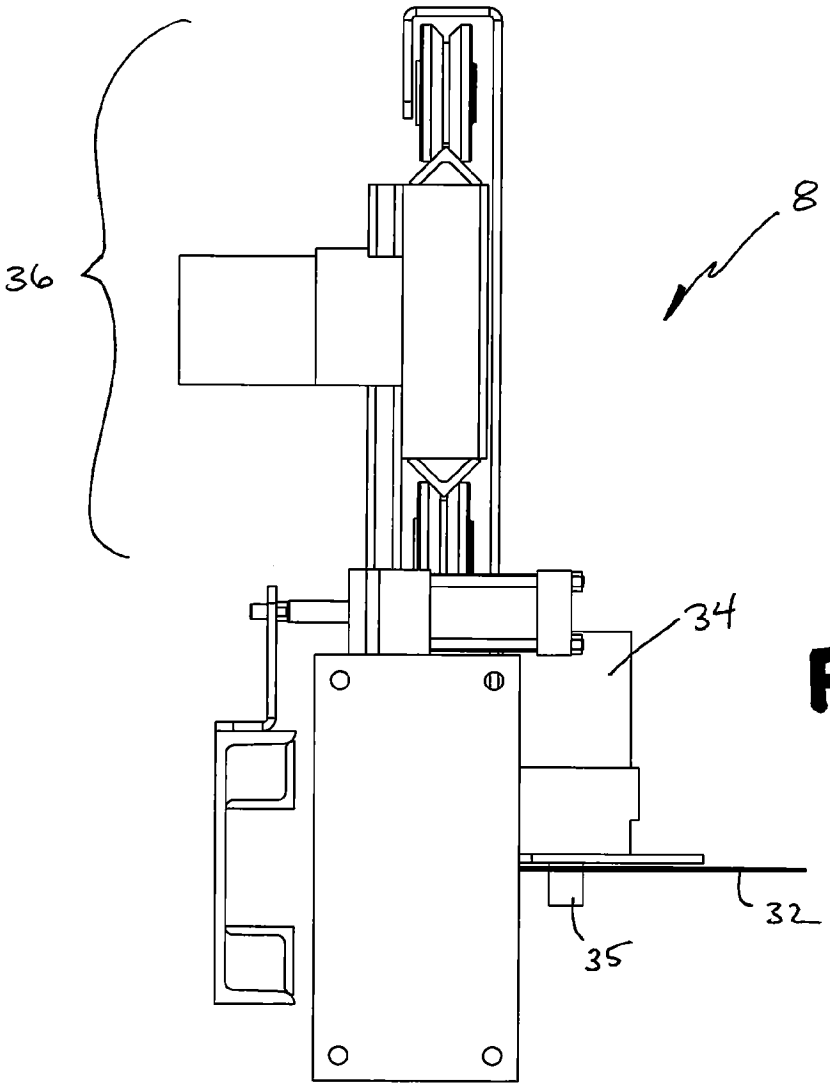
FIG. 3 is a top plan view of one embodiment of the cut off mechanism of the present invention.

Referring now to FIG. 3, one embodiment of the cut off mechanism 8 of the present invention is shown. The cut off mechanism 8 is located and configured such that it cuts the reinforcing material at a location below the nip rollers 6, so as to allow the embedding machine 2 to maintain the proper amount of tension in the material between the payoff carriage 4 and the nip rollers 6. In the depicted embodiment, the cut off mechanism 8 includes a 14-inch diameter, diamond impregnated cutting blade 32 powered by a 2,000 rpm hydraulic cutoff motor 34 with a 1-inch diameter arbor 35 for gripping the blade. The cut off mechanism 8 is mounted on a hydraulic pressure motorized carriage 36 and track which is configured to allow the cut off mechanism 8 to freely traverse the entire width of the frame 18, in either direction. In operation, the cut off mechanism 8 utilizes a hydraulic powered clamp to grip the reinforcement material and prevent it from moving while the motor 34 causes the cutting blade 32 to rotate with sufficient speed to cleanly cut the material. In order to ensure that the material is cut evenly across the entire width of the embedding machine 2, the carriage 36 moves the cutting blade 32 across the entire width of the strengthening material, while the material is clamped in place. The cutoff motor 34, and thus the cutting blade 32, the clamp and the cut off carriage 36, are controlled by valves located at the control panel 16, which allow the operator to control whether the clamp grips or releases the material, whether the motor 34, and therefore the cutting blade 32, is on or off, and which direction to move the carriage 36. As appreciate by one skilled in the art, other types of cutting devices may be used for the same purpose, such as an industrial textile blade cutter, an abrasive water jet machining system, a laser cutting device, or any other device capable of being incorporated into the cut off mechanism 8 and quickly cutting the strengthening material at the desired length.

Figure 4:
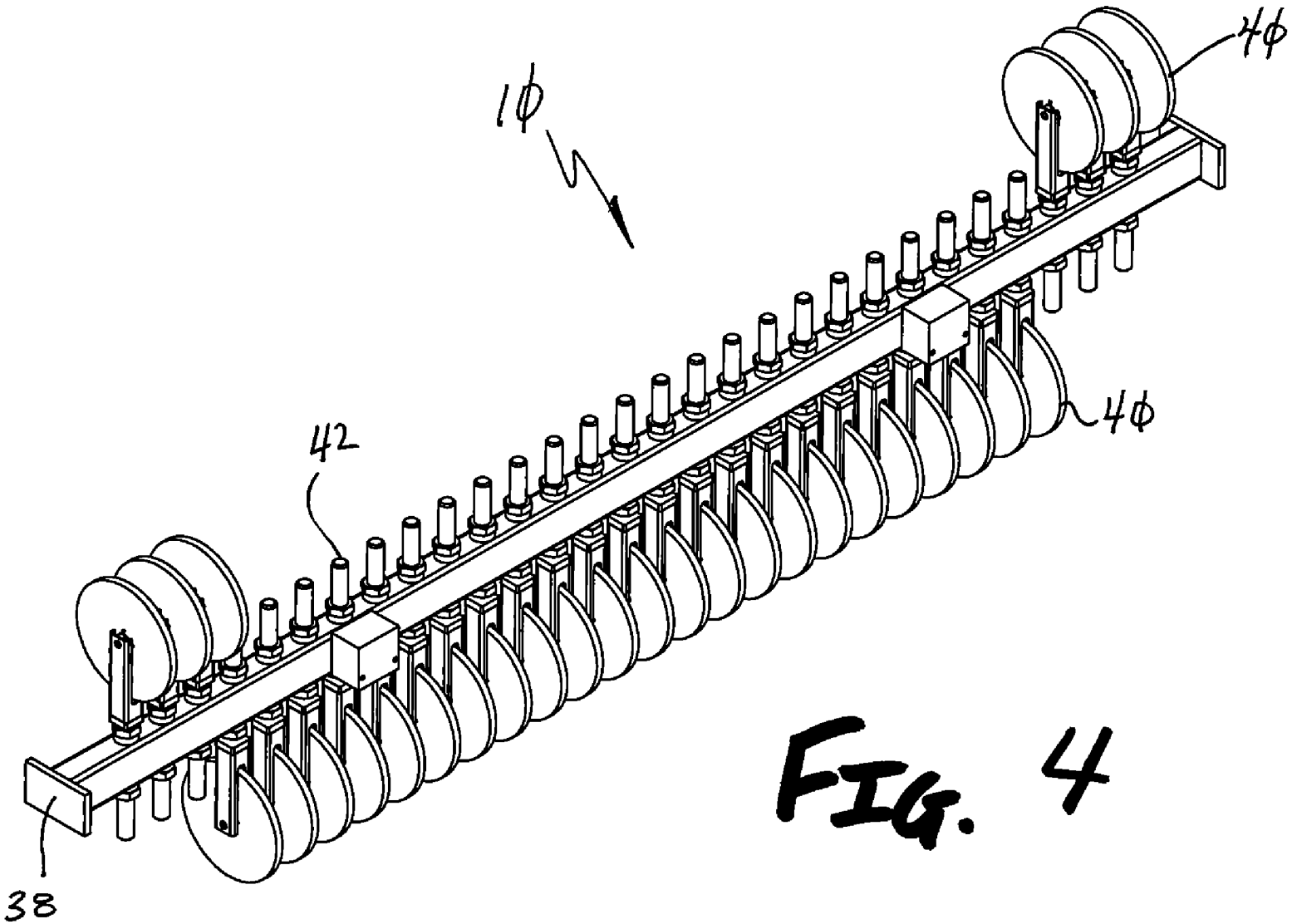
FIG. 4 is a perspective view of one embodiment of an embedment roller assembly of the present invention.

Referring now to FIG. 4, one embodiment of the embedment roller assembly 10 of the present invention is shown. In this embodiment, the embedment roller assembly 10 includes a beam 38 that is of a length equal to the interior width of the frame 18 with a plurality of rollers 40 removably connected thereto. The beam 38 is mounted to the embedding machine 2 via hydraulic pressure powered cylinders which allow the operator to position the beam at a desired elevation for embedding and also allow the beam to be retracted out of the embedding area the event that the embedding machine 2 approaches obstacles that may cause damage to the beam 38 or the rollers 40. Each roller 40 preferably has a 16-inch diameter with a one-half inch face width at the point of contact with the reinforcing material and is made of high density polyurethane. Each roller 40 includes means for adjusting its height 42, which allows the embedment roller assembly 10 to be configured to embed strengthening material into a variety of shaped concrete components 50. In the depicted embodiment, the adjustment means 42 include a threaded end and a nut which allows each roller 40 to be adjusted upward or downward, or even removed entirely if desired, by tightening or releasing the nut. While this is the preferred embodiment, it will be appreciated by one of skill in the art that the adjustment means 42 may also be one of several other means by which an item may be slidably moved up or down and then secured in place for operation, such as band clamps, web clamps, toggle clamps, vices, set screws, and similar devices.

In operation, the embedment roller assembly 10 receives reinforcing material from the nip rollers 6 and presses the material into the concrete component 50 at any desired elevation or plurality of elevations, depending upon the configuration of the rollers 40. To embed reinforcing material into a concrete component 50 containing a complex contour profile, a template may be made conforming to the contour profile which will allow the rollers 40 to be properly adjusted and thus embed the material into the concrete component 50 at the proper depth. In order to ensure that the embedment roller assembly 10 does not damage the reinforcement material during embedding, the embedment roller assembly 10 also includes dual high frequency (preferably 9,000 cycles/minute) hydraulic vibrators, attached at each end of the beam 38, which vibrate the beam 38 and rollers 40, thus facilitating embedment of the material into the concrete component 50. The embedment roller assembly 10 is controlled by valves located at the control panel 16, which allow the operator to raise or lower the embedment roller assembly 10 and/or cause the hydraulic vibrators to vibrate the embedment roller assembly 10 in fast, slow or stop modes.

Figure 5:
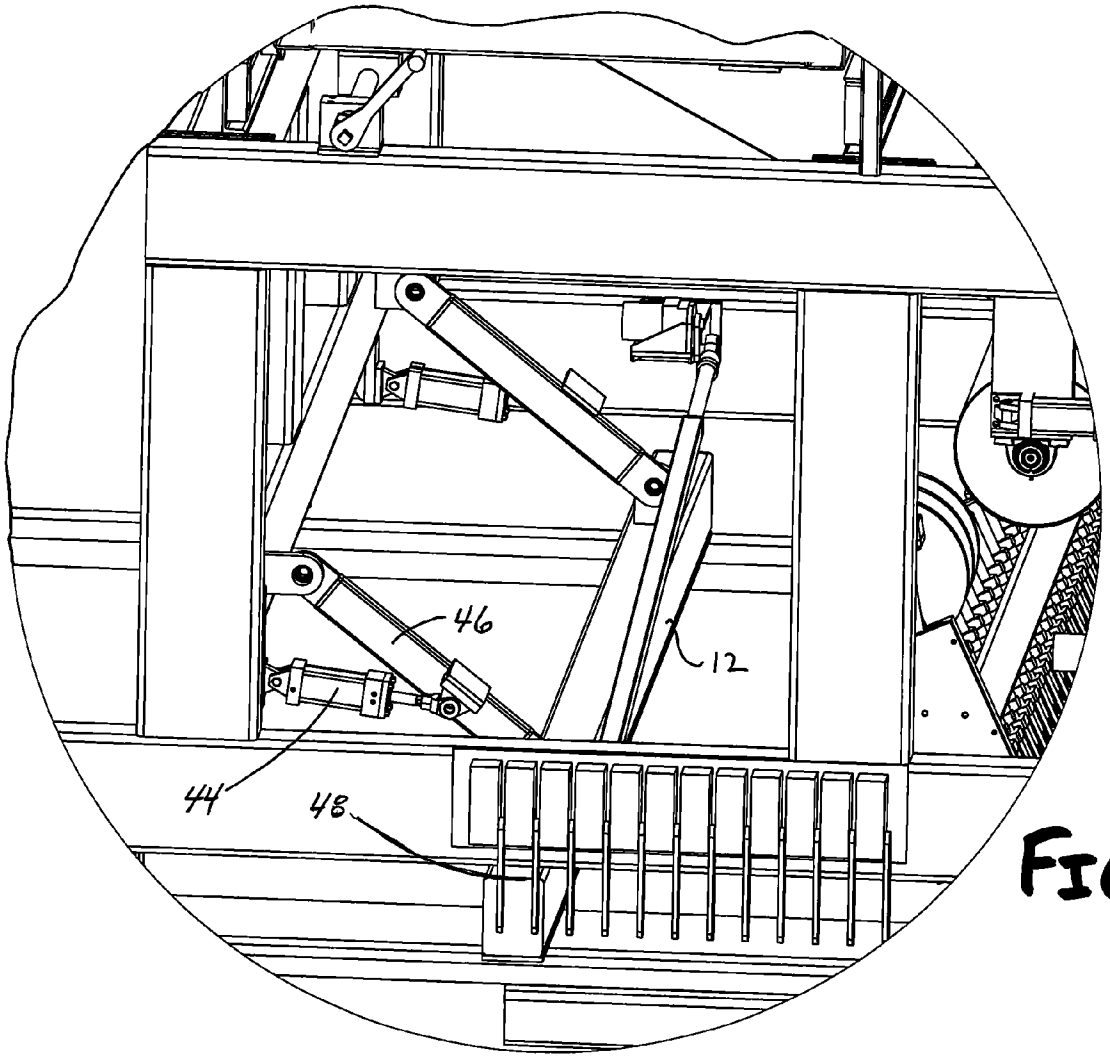
FIG. 5 is a partial detailed perspective view of one embodiment of a screed leveling beam of the present invention.
Figure 6:
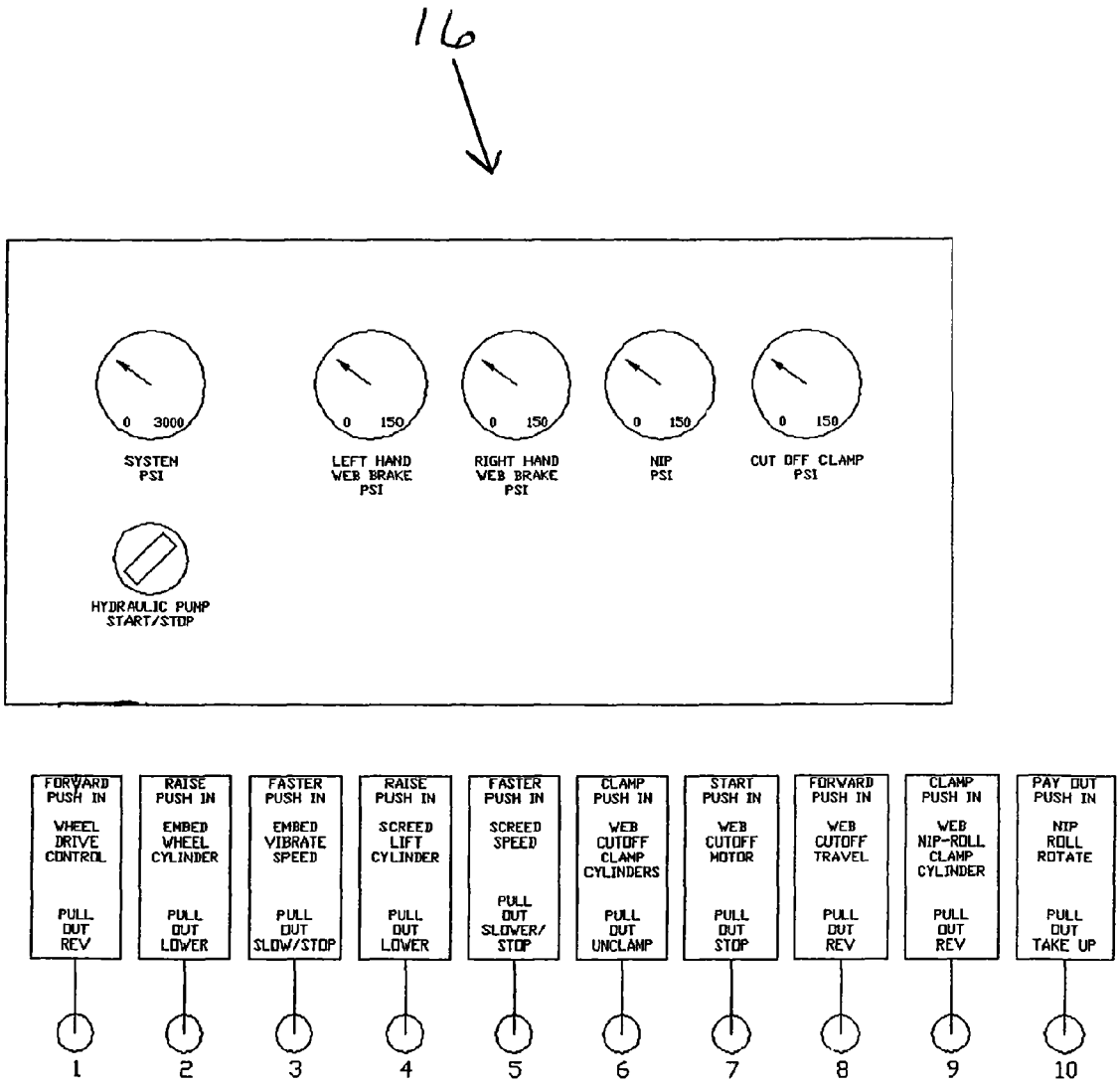
FIG. 6 is a view of one embodiment of the control panel of the present invention.

Referring now to FIG. 5, one embodiment of the screed leveling beam 12 of the present invention is shown. In the depicted embodiment, the screed leveling beam 12 is of a length equal to the interior width of the frame 18 and includes adjustable edge wings 48 on each end of the beam 12 to contain the concrete within the desired form or shape, so that none is lost during operation of the screed leveling beam 12. The screed leveling beam 12 is attached to the frame 18 of the embedding machine 2 via two attachment arms 46 which are operable to provide lift and/or to lower the screed leveling beam 12 via hydraulic cylinders. In operation, the screed leveling beam 12 oscillates back and forth across the surface of the concrete component 50 after the reinforcing material has been embedded by the embedment roller assembly 10, in order to create a smooth surface along the face of the concrete component 50. The length of each oscillation may be as much as six inches forward or back and is accomplished via two hydraulic oscillation motors 44 connected to the frame 18 at one end and the attachment arms 46 at the other. The speed of oscillation is variable and may be controlled by the operator at the control panel 16. As appreciated by one skilled in the art, the screed leveling beam 12 can be configured to move in any direction that is capable of smoothing the surface of the concrete component 50 after the strengthening material has been embedded.

Figure 7:
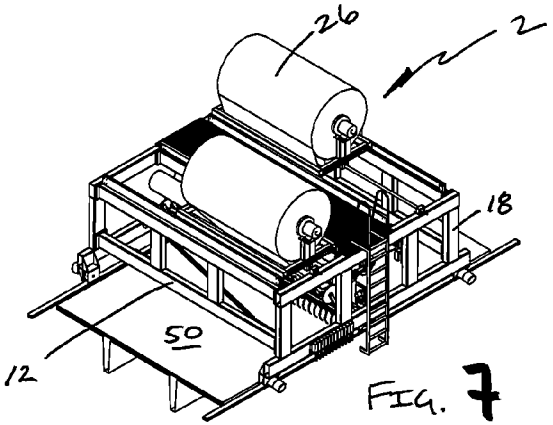
FIG. 7 is a top perspective view of another embodiment of the present invention.
Figure 12:
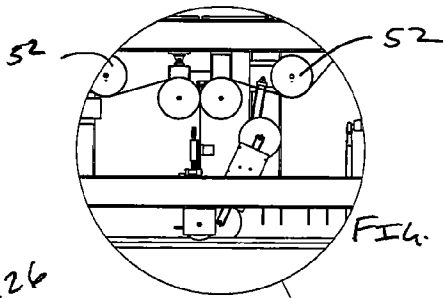
FIG. 12 is a detailed view of FIG. 11.
Figure 11:
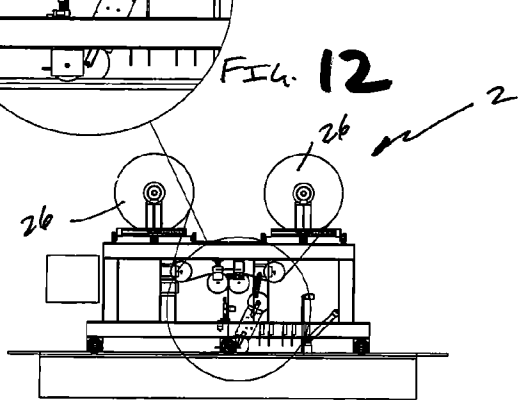
FIG. 11 is a rear elevation view of the apparatus shown in FIG. 7.
Figure 10:
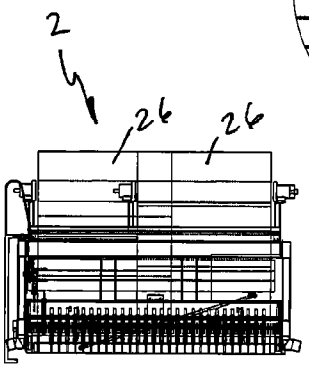
FIG. 10 is a left elevation view of the apparatus shown in FIG. 7.
Figure 8:
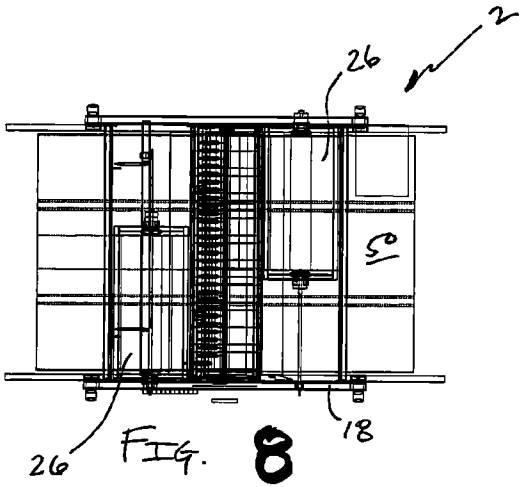
FIG. 8 is a top plan view of the apparatus shown in FIG. 7.
Figure 9:
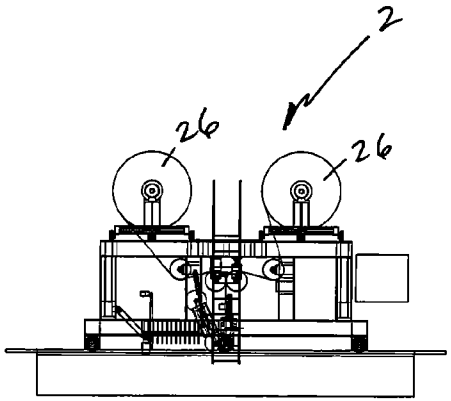
FIG. 9 is a front elevation view of the apparatus shown in FIG. 7.

The embedding machine 2, as well as all of the functions of its moving components, is capable of being controlled by a single operator via the operator control panel 16 (FIG. 7). In order to have adequate electrical power for the control panel 16 to operate, the embedding machine 2 includes a 100 Amp generator operably connected to the control panel 16. The control panel 16 allows the operator to perform the following tasks: switch the hydraulic pump on or off; propel the embedding machine 2 forward or in reverse; raise or lower the embedment roller assembly 10; cause the embedment roller assembly 10 to vibrate in fast, slow or stop modes; lift or lower the screed leveling beam 12; cause the screed leveling beam 12 to oscillate in fast, slow or stop modes; clamp or release the reinforcement material via the cut off mechanism 8; turn the cut off motor on or off, cause the cut off motor 34 to travel forward or reverse; cause the nip rollers 6 to clamp or release the reinforcement material; and direct the rotation of the nip rollers 6 to either pay out, or take up the material.

Referring now to FIGS. 7-11, another embodiment of the apparatus of the present invention is shown. As with the previously described embodiments, this embodiment of the apparatus is an embedding machine 2 that includes at least one, and preferably at least two, payoff carriages 4 that each house a large roll 26 of reinforcement material. In this embodiment, however, the free end of the reinforcement material is fed downward from each payoff carriage 4, around a positioning roller 52 located beneath each payoff carriage 4, and then to a pair of compliant nip rollers 6 that meter and/or dispense the reinforcement material to an embedding area beneath the embedding machine 2. In this embodiment, each of the positioning rollers 52 is preferably 16 inches in diameter, the same length as the roll of the strengthening material being dispensed from the payoff carriage 4, and has a one-quarter inch thick compliant medium bonded to its outer surface which assists the positioning rollers 52 in accepting and gripping the reinforcing material during operation of the embedding machine 2. When in use, the positioning rollers 52 freely rotate in either direction and are passively operated such that the relative speed and the direction of rotation of the positioning rollers 52 is determined by the relative speed and the direction of rotation of the nip rollers 6 and the payoff carriages 4. The positioning rollers thus assist the operator of the embedding machine 2 in maintaining tension in the strengthening material by providing another point of contact between the payoff carriage 4 and the nip rollers 6.

While various embodiment of the present invention have been described in detail, it is apparent that modifications and adaptations of those embodiments will occur to those skilled in the art. However, it is to be expressly understood that such modifications and adaptations are within the scope and spirit of the present invention, as set forth in the following claims.

What is claimed is:

1. A method for inserting a reinforcing material in a form adapted to create a concrete structure, comprising:

providing a form with a predetermined shape capable of receiving a concrete material;

positioning said concrete material into the form;

positioning an embedding machine substantially over the form at a first end of the form, said embedding machine comprised of a plurality of rollers that are each selectively adjustable, thereby allowing the embedment roller assembly to be configured to embed reinforcing material into a variety of shaped concrete components;

dispensing the reinforcing material from at least one payoff carriage, through a pair of nip rollers, and into an embedding area positioned beneath the embedding machine;

utilizing an embedment roller assembly to position the reinforcing material into the concrete material at a desired depth;

moving the embedding machine from the first end of the form to a second end of the form while positioning the reinforcing material into the concrete material;

cutting the reinforcing material when a desired amount has been dispensed; and leveling the surface of the concrete material with a screed leveling beam.

2. The method of claim 1, wherein, during dispensing, the reinforcing material is dispensed from the at least one payoff carriage and over a positioning roller before it is dispensed through the pair of nip rollers.

3. The method of claim 1, wherein the reinforcing material is comprised of at least one of a metallic mesh, an alkali-resistant glass, a fiberglass, a polypropylene, a polyethylene, a polyester, an acrylic, a kevlar, a crysotile asbestos, a crocidolite asbestos, a high-modulus carbon fiber, and a high-strength carbon fiber.

* * * * *